US011224316B2

(12) United States Patent
Sulik et al.

(10) Patent No.: US 11,224,316 B2
(45) Date of Patent: Jan. 18, 2022

(54) ROLLED WEB MATERIAL DISPENSER MATERIAL LOCKOUT SYSTEMS

(71) Applicant: San Jamar, Inc., Elkhorn, WI (US)

(72) Inventors: Jarod Sulik, Elkhorn, WI (US); Bernie Ziebart, Pewaukee, WI (US)

(73) Assignee: San Jamar, Inc., Elkhorn, WI (US)

( * ) Notice: Subject to any disclaimer, the term of this patent is extended or adjusted under 35 U.S.C. 154(b) by 0 days.

(21) Appl. No.: 16/828,414

(22) Filed: Mar. 24, 2020

(65) Prior Publication Data

US 2020/0323403 A1 Oct. 15, 2020

Related U.S. Application Data

(63) Continuation-in-part of application No. 16/368,191, filed on Mar. 28, 2019.

(51) Int. Cl.
*A47K 10/38* (2006.01)

(52) U.S. Cl.
CPC ..... *A47K 10/3845* (2013.01)

(58) Field of Classification Search
CPC ..... A47K 10/3845; A47K 2010/3681; A47K 10/16; B65H 75/185; B65H 75/08
USPC ..... 242/596, 596.4, 596.5, 596.7
See application file for complete search history.

(56) References Cited

U.S. PATENT DOCUMENTS 1,119,179 A * 12/1914 Krauth ..... B65H 16/06 242/596.5
1,716,812 A 6/1929 Ball
2,562,923 A * 8/1951 Kolivoski ..... B65H 75/08 242/571.5
2,905,404 A * 9/1959 Simmons ..... A47K 10/40 242/423.2
3,552,669 A 1/1971 Earnest
3,885,755 A * 5/1975 Bezrutczyk ..... B23K 3/08 242/129.5
3,986,677 A * 10/1976 Ootaki ..... A47K 10/40 242/560.3
4,108,513 A 8/1978 Lander
(Continued)

FOREIGN PATENT DOCUMENTS

EP 1064876 B1 3/2005
EP 3395738 A2 10/2018

OTHER PUBLICATIONS

The Extended European Search Report for the European Patent Application No. EP 20217079, dated Jun. 21, 2021.

*Primary Examiner* — William A. Rivera
(74) *Attorney, Agent, or Firm* — Boyle Fredrickson S.C.

(57) ABSTRACT

A lockout system that limits use of a rolled web material dispenser assembly to dispense only authorized rolls of web material. The lockout system includes a hub and an insert that cooperate with one another to define mating registration elements that removeably cooperate with one another and provide a rotational cooperation therebetween when engaged with one another. The insert is shaped to be received in a bore of discrete authorized roll of web material. In one embodiment, the insert includes an overlapping portion formed between opposing ends of the insert and preferably between rotational bearing surfaces associated therewith. In another embodiment, the hub supported by the dispenser is moveable relative to the dispenser and renders the hub unavailable for operative cooperation with inserts that are not configured for cooperation therewith.

24 Claims, 7 Drawing Sheets

(56) References Cited

U.S. PATENT DOCUMENTS

| | | | | | |
|---|---|---|---|---|---|
| 4,171,781 | A * | 10/1979 | Kral | B65H 75/08 | 242/564.4 |
| 4,557,426 | A | 12/1985 | Siciliano | | |
| 4,821,974 | A * | 4/1989 | Poehlein | B65H 16/06 | 242/129.51 |
| 5,310,129 | A | 5/1994 | Whittington et al. | | |
| 5,322,234 | A * | 6/1994 | Robert | A47K 10/40 | 242/596.7 |
| 5,535,955 | A * | 7/1996 | Enger | B65H 54/34 | 242/129.51 |
| 5,636,812 | A | 6/1997 | Conner et al. | | |
| 6,390,410 | B1 * | 5/2002 | LaCount | A47K 10/40 | 242/571.5 |
| 6,491,251 | B1 | 12/2002 | Stanland et al. | | |
| 6,648,267 | B2 | 11/2003 | Stanland et al. | | |
| 7,014,140 | B2 | 3/2006 | Elliott et al. | | |
| 7,044,419 | B2 | 5/2006 | Moore | | |
| 7,114,676 | B2 | 10/2006 | Elliott et al. | | |
| D543,402 | S | 5/2007 | Goeking et al. | | |
| D543,745 | S | 6/2007 | Goeking et al. | | |
| D556,482 | S | 12/2007 | Goeking et al. | | |
| 7,461,810 | B2 | 12/2008 | Goeking et al. | | |
| 8,356,767 | B2 | 1/2013 | Formon et al. | | |
| 8,479,957 | B2 | 7/2013 | Ophardt | | |
| 10,028,627 | B2 * | 7/2018 | Boeltl | A47K 10/40 | |
| 2003/0146339 | A1 * | 8/2003 | Liu | B65H 16/06 | 242/596.4 |
| 2007/0063092 | A1 * | 3/2007 | Zevin | B65H 16/06 | 242/571.5 |
| 2015/0150422 | A1 * | 6/2015 | Ochoa, Sr. | A47K 10/16 | 242/596.7 |
| 2017/0071419 | A1 | 3/2017 | Gscheidmeier et al. | | |

* cited by examiner

ROLLED WEB MATERIAL DISPENSER MATERIAL LOCKOUT SYSTEMS

CROSS-REFERENCE TO RELATED APPLICATIONS

This is a continuation-in-part non-provisional patent application and claims priority to U.S. Non-provisional patent application Ser. No. 16/368,191 filed on Mar. 28, 2019 titled "Rolled Web Material Dispenser Material Lockout Systems", and the disclosure of which is expressly incorporated herein.

BACKGROUND OF THE INVENTION

The present invention is generally directed to a dispenser product lockout system and, more particularly, to a rolled web material dispenser having a mechanical lockout feature that prevents use of a dispenser assembly for dispensing rolled web material that is acquired from non-approved or unauthorized sources.

Conventional rolled web material dispensers for use in dispensing hand towel and toilet tissue material or the like often advance the web material from a roll as the roll rotates about a spindle, bobbin, or hub located within the dispenser. Upon depletion of the rolled web material, the dispenser housing is opened, and a replacement roll of web material is then placed within the dispenser. Conventional rolls of web materials may be coreless or include a hollow core for receiving a generic or common spindle that extends laterally through the core and whose opposing ends are supported by the dispenser housing. When provided in a coreless configuration, the axially opposing end located portions of the web material may be pinched between opposing fingers or compression assemblies that collectively define the rotational axis of the roll of web material relative to the dispenser.

Whether provided in a cored or coreless configuration of rolled web material, conventional paper and web material roll dispensers are not commonly configured to selectively dispense only a particular type, style, or roll of web material or a roll of web material from a particular manufacturer. Accordingly, it is possible for a size discrepancy or mismatch to occur between the dispenser and the roll of web material, thereby inhibiting the proper dispensing of the web material.

Such systems also present the potential that service providers or employees may configure such dispensers to dispense product having less desirable construction or performance characteristics via cheaper source suppliers or the like. Shortcomings in the dispense operation can sometimes be incorrectly attributed to subpar operability of the dispenser assembly rather than being attributable to deviations in the manufacture of the discrete rolled web material and/or use of rolled web materials that are ill-suited for being dispensed from a given dispenser assembly or produced with subpar manufacturing practices. Improper or less than efficient operation of the rolled web material dispenser to dispense rolled web material in a repeatable manner, but attributable to improper loading or use of a dispenser with web material not properly configured for cooperation with a discrete dispenser assembly, may reflect adversely on the manufacturer of the dispenser rather the establishment or service provider associated with maintaining operation of the discrete dispenser assemblies once deployed and ensuring that only suitable rolled web materials are associated therewith. Accordingly, there is a need for a roll dispenser that is constructed to limit use of the dispenser assembly to dispense only desired rolled web materials and thereby inhibit use of the dispenser assembly to dispense rolls of web material that have not be authorized to be dispensed from the corresponding dispenser.

Further, a need exists for lockout features that prevent necessary positioning or support of unauthorized rolls of web material relative to a given dispenser. In such a lockout system, in the event that there is an inconsistency between a registration component associated with a core of the roll and a mating registration portion associated with the hub or spindle of the dispenser, the roll of material will not be accepted into the dispenser in an operable manner thereby inhibiting use and/or proper support for dispensing of an unauthorized roll of web material.

A further need exists for a lockout roll dispensing system that is relatively inexpensive to manufacturer, produce, and maintain in a useable condition, inhibits use of unauthorized rolls of web materials, and solves other problems associated with existing configurations. A still further need exists for a dispenser assembly roll of web material lockout system that can be quickly and conveniently implemented into existing or previously deployed dispenser assemblies and which includes separable elements that can be configured to designate rolls of web material as authorized to be dispensed with dispenser assemblies that have been reconfigured to include the lockout system. A need further exists for roll web material lockout systems that provide robust support of authorized materials to facilitate the sequential rotational dispensing of the web material from the bulk roll. A further need exists for rendering a dispenser assembly incapable of supporting those rolled web material rolls that do not include the mating registration element.

SUMMARY OF THE INVENTION

The present invention discloses a roll of web material lockout system that resolves one or more of the shortcomings disclosed above.

One aspect of the present application discloses a web material roll lockout assembly that includes a hub that is constructed to be supported by a dispenser. A channel is formed in a radially outward oriented surface of the hub and positioned such that the channel is formed proximate an end of the hub. The assembly includes an insert that is constructed to removeably cooperate with the hub and has an overlapping portion formed between opposing ends of the insert. A plurality of projections are defined by the insert and constructed to limit axial translation between the insert and the hub when at least one of the plurality of projections is engaged with the channel and such that the overlapping portion of the insert improves flexibility associated with movement of the plurality of projections. A first rotational bearing surface and a second rotational bearing surface are defined between the insert and the hub when the at least one of the plurality of projections is engaged with the channel. The first rotational bearing surface and the second rotational bearing surface are positioned so that the overlapping portion of the insert is disposed therebetween.

Another aspect of the present application discloses a method of restricting rolls of web material that can be dispensed from a roll dispenser. The method includes providing a hub that defines an axis of rotation of a roll of web material associated with the roll dispenser. An insert is provided that has an outer diameter that is constructed to securely engage a bore of a roll of web material and has a radially inward directed shape that slideably cooperates with the hub. A portion of the insert is formed to overlap itself as the insert traverses from opposing ends thereof and such that, when the insert is engaged with the hub, cooperation of the insert and the hub restricts axial translation between the hub and the insert and accommodates rotation of the insert relative to the hub during rotation of a roll of web material. Engagement of a respective insert with the hub defines at least two bearing surfaces between the insert and the hub wherein each of the at least two bearing surfaces are offset in an axial direction from respective longitudinal ends of the insert and the hub and such that the overlapping portion of the insert is preferably disposed between the at least two bearing surfaces.

A further aspect of the present application discloses an insert for use in a roll web material dispenser assembly. The insert includes a body that extends between a first end and a second end of the insert. An outer surface of the body of the insert is shaped to be received in a roll of web material and an inner surface of the body of the insert is shaped to removeably cooperate with a hub associated with a dispenser and to define at least two bearing surfaces that are axially offset from one another when engaged with the hub. The insert includes a plurality of deflectable fingers that are associated with a first end of the body and a projection is associated with at least one of the plurality of deflectable fingers and oriented to engage a groove defined by the hub. The body defines an overlapping portion of the insert between the first end and the second end of the insert and is positioned between the at least two bearing surfaces.

Another aspect of the present application discloses a web material roll lockout assembly that include a support arm that is constructed to engage a dispenser housing. A carriage is engaged with the support arm and a hub is supported by the carriage such that the hub is movable relative to the carriage between an exposed position wherein a portion of the hub is accessible and a retracted position wherein the portion of the hub is inaccessible. The assembly includes a biasing device that is configured to bias the hub toward the exposed position. An insert is constructed to be disposed in a bore of a roll of web material and to slideably cooperate with the hub so that the hub engages the insert without translating the hub relative to the carriage toward the retracted position.

A further aspect of the present application discloses a method of forming a web material lockout assembly. The method includes forming an insert so that an outer geometric shape of the insert allows the insert to be slideably received in a bore of a roll of web material and forming an inner geometric shape of the insert to be shaped to removeably cooperate with a hub supported by a dispenser. The hub is supported so that the hub is slideable relative to the dispenser so that the hub is rendered inaccessible for supporting engagement if an insert having a different inner geometric shape is attempted to be operatively associated therewith.

Another aspect of the present application discloses a web material dispenser lockout system that includes a support assembly that is constructed to cooperate with a dispenser housing. A hub slideably engages the support assembly so that the hub is movable between an extended position and a retracted position. A biasing device is engaged with the hub and oriented to bias the hub toward the extended position. The lockout system includes an insert that is constructed to be disposed in a bore of a roll of web material and has a radially interior facing geometry that allows the insert to cooperate with the hub without translating the hub toward the retracted position.

These and other aspects, features, and advantages of the present invention will become apparent from the detailed description, claims, and accompanying drawings.

DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which:

FIG. 7 is an a roll facing exploded perspective view of the lockout assembly shown in

FIG. 6;

DETAILED DESCRIPTION OF THE PREFERRED EMBODIMENTS

Figure 1:
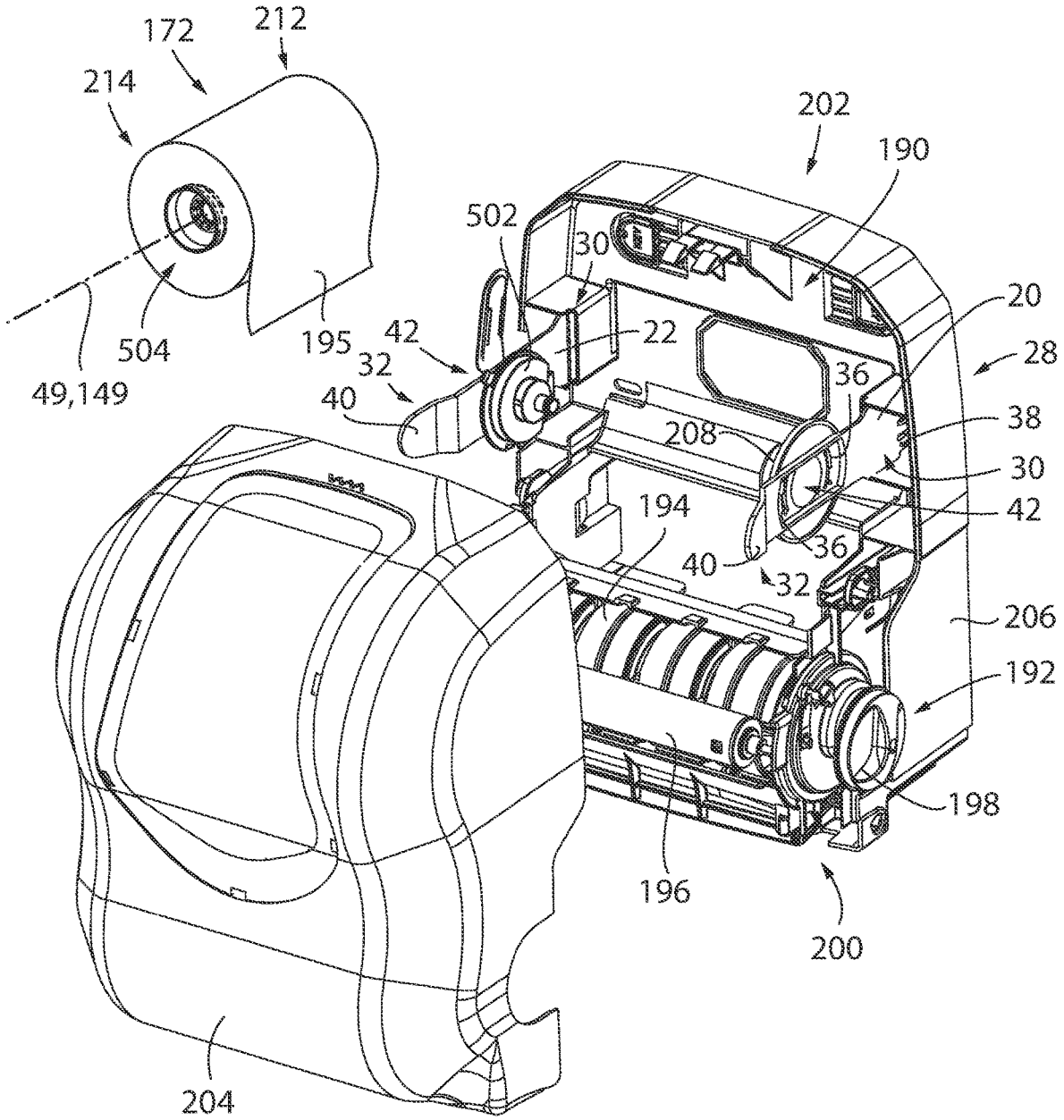
FIG. 1 is a partially exploded perspective view of a rolled web material dispenser assembly equipped with a rolled material lockout assembly according to one embodiment of the present invention.

In describing the preferred embodiments of the invention which are illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. The various features and advantageous details of the subject matter disclosed herein are explained more fully with reference to the non-limiting embodiments described in detail in the following description.

Figure 2:
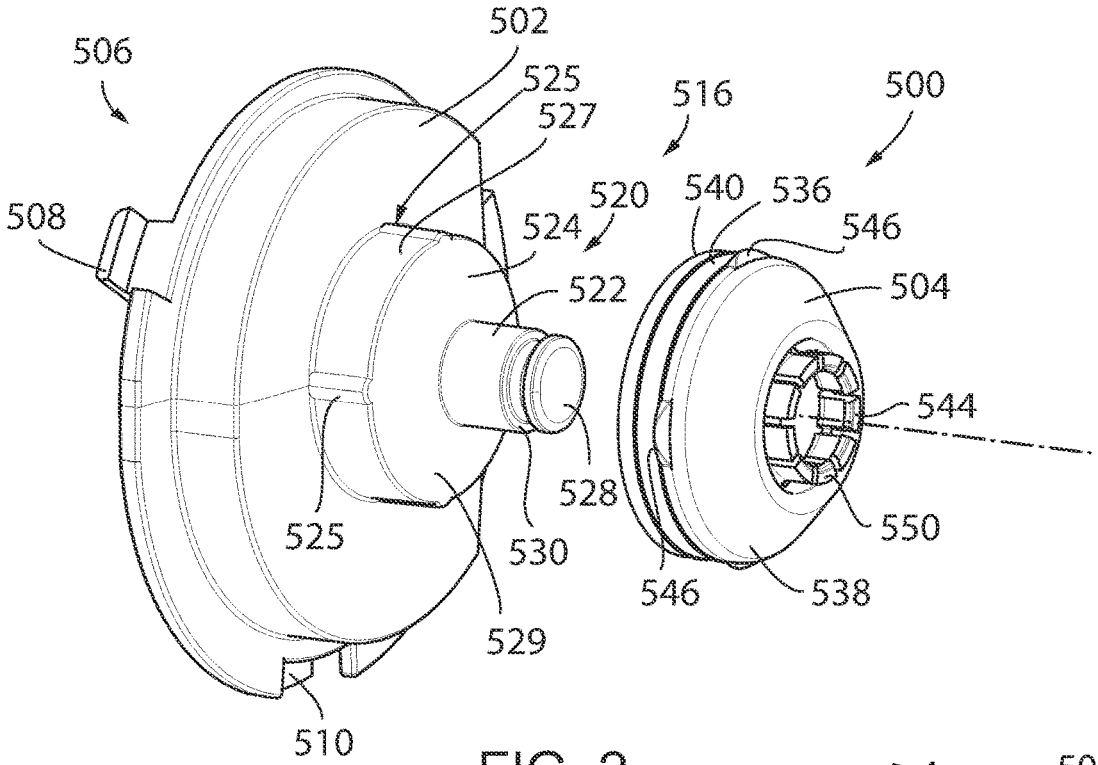
FIG. 2 is a perspective view of the rolled material lockout assembly shown in FIG. 1 removed from the dispenser assembly.

Illustrative embodiments of rolled web material lockout systems in accordance with various aspects of the present invention are shown in FIG. 1 through FIG. 9. FIGS. 1-5, and initially FIG. 1, shows a rolled material lockout system or lockout assembly 500 according to one embodiment of the present application and that is constructed to cooperate with rolled web material dispensers or dispenser assemblies, such as dispenser assembly 28, as shown in FIG. 1. Referring to FIGS. 1 and 2, roll lockout system 500 includes a hub 502 that is constructed to cooperate with support arm 22 associated with dispenser assembly 28 and an insert or core insert 504 that is constructed to be received in a cavity or bore 210 of a roll of web material 172 and removeably cooperate with hub 502. It is appreciated that support arm 22 may be constructed to snap-fittingly cooperate with an enclosure or housing 202 defined by dispenser assembly 28 such that the roll material housed thereby can be dispensed in an unwinding or unrolling manner when the housing 202 is oriented in a generally closed configuration as disclosed further below.

Although being shown as removeably cooperating with support arm 22, it is appreciated that hub 502 could be constructed in a generally unitary construction to include the structure of support arm 22 associated with facilitating the connection of support arm 22 to housing 202 of dispenser assembly 28. Roll support arm 22 is preferably configured to snap-fittingly cooperate with housing 202 such that the support arm 22 extends in a generally linear manner along a length from a first end 30 to an opposing second end 32. The first end 30 of the roll support arms 20, 22 preferably includes one or more resilient catches which each preferably include a respective opposing barb 38 formed proximate thereto and that are configured to releasably engage a receiving slot formed in the dispenser housing 202. The opposing second end 32 of the roll support arm 22 has a generally arcuate tab 40 that is configured to allow a user to selectively deflect the respective support arm 22 in a generally outward lateral direction relative to a roll of web material 172 to assist in the association of an authorized roll with dispenser assembly 28 and/or the removal of the core of a spent or partially consumed roll therefrom. It is further appreciated that opposing second end 32 of support arm 22 could be configured to cooperate with an interior facing surface of a cover 204 of dispenser assembly 28 when the cover 204 is oriented in a closed position. Such a consideration allows the weight of the rolled web material to be distributed over both ends 30, 32 of each respective roll support arm 22 and maintain a bias of one or more of ends 32 in a direction toward engagement with roll of web material 172 when housing 202 is oriented in a closed orientation. Support arms 20, 22 are constructed to support the opposing ends 212, 214 of a discrete roll of web material 172 in a cantilevered fashion relative to the respective ends 30 of support arms 20, 22 and the housing 202 of dispenser assembly 28 as disclosed further below.

When provided in a removable or selectively severable methodology, at least one of arms 20, 22 defines a hub receiving area 42 that is disposed along a front or roll facing surface of the length of the respective roll support arm 20, 22 between the first and second ends 30, 32. Preferably, the hub receiving area 42 includes an optional and preferably circular hollow center or void formed thereat. It should be understood that the present invention is not so limited and that any alternative configuration of the hub receiving area 42 is considered within the scope of the present invention. Referring to FIG. 1, the hub receiving area 42 of one or more of support arms 20, 22 includes a plurality of receiving slots 36 that are annularly disposed proximate the perimeter of the hub receiving area 42 for receiving and mating to the hub 502 as described further below.

During implementation, or upon depletion of the roll of web material 172, the cavity 190 of dispenser assembly 28 may be exposed to allow the user access thereto. Dispenser assembly 28 includes a feed mechanism 192 that is constructed to cooperate with a free end 195 of roll of web material 172 to effectuate each dispense activity. Feed mechanism 192 includes a number of rollers 194, 196 that are constructed to effectuate the dispense activity and thereby unwind the roll of web material 172 during each dispense action. Dispenser assembly 28 includes an optional handle 198 that is operational to effectuate manual operation of one or more of rollers 194, 196 to effectuate the dispense activity. Although configured to accommodate manual dispensing operation, it is appreciated that dispenser assembly 28 could be provided to operate in an automatic or touchless manner via the inclusion of various proximity sensors and drive systems configured to actuation operation of rollers 194, 196 in response to the proximity of a user, or user's hand, relative to a throat or dispense opening 200 of dispenser assembly 28 when in the ready for use configuration or with other manual actuation assemblies such as manually operable lever arms, push paddles, or the like.

As disclosed above, housing 202 of dispenser assembly 28 is generally defined by a cover 204 that movably or pivotably cooperates with a base 206 such that opening of housing 202 of dispenser assembly 28 exposes cavity 190 associated with accepting an authorized roll of web material 172. As shown in FIG. 1, dispenser assembly 28 preferably includes at least two support arms 20, 22 that are disposed on generally opposite lateral sides of cavity 190. One of support arms 20, 22 includes a bobbin or a boss 208 that is shaped to cooperate with a respective end of a bore or hollow bore 210 of a roll of web material 172 of indiscriminate source. It is appreciated that the axially extending bore 210 of the discrete rolls of web material can be defined by a cigarette of the roll of material, a cardboard or other rigid material core tube upon which the web paper material is wound, or other methodologies commonly employed in the web paper roll material forming processes to create the hollow bore associated with the roll of web material. Regardless of the methodology employed, boss 208 is shaped to rotationally support a roll of web material from a majority of sources of rolled web material. The other of support arms 20, 22 of dispenser assembly 28 is provided with or otherwise constructed to define hub 502.

In the embodiment shown in FIG. 1, it can be appreciated that support arm 22 includes the hub 502 of lockout system or assembly 500 as authorized roll of web material 172 includes a corresponding core insert 504 that is constructed to removeably cooperate with or engage hub 502. It should be appreciated that the association of hub 502 and insert 504 could be provided at either of the longitudinal ends 212, 214 defined by roll of web material 172 or that dispenser assembly 28 can be readily configured to operate with other lockout systems or assemblies, such as lockout assembly 600 as disclosed further below, via the replacement of the respective lockout enabled support arm 22 and/or engagement of other hubs 502 of hub assemblies 602 as disclosed further below, associated with a discrete respective one of support arms 20, 22. It is further appreciated that, although dispenser assembly 28 is shown as being equipped with one lockout system or assembly 500, associated with accommodating use of dispenser assembly 28 with a roll of web material 172 having a corresponding respective insert 504 associated with a respective one of lateral or axial ends 212, 214 of authorized roll of web material 172, dispenser assembly 28 could be configured to include a pair of lockout assemblies 500 wherein each lockout assembly 500 is associated with a respective one of support arms 20, 22.

As mentioned above, it is appreciated that one of lockout assemblies 500, 600 can be configured to cooperate with only one of the respective axial ends 212, 214 of authorized rolls of web material 172 and in a manner wherein the "overhand" (as shown in FIG. 1) or "underhand" unwinding orientation of the authorized roll of web material 172 relative to dispenser assembly 28 creates a desired presentation of the free end 195 of the authorized roll of web material 172 at feed mechanism 192 to effectuate the desired continual sequential dispensing of the web material 172 from dispenser assembly 28. After an authorized roll of web material 172 has been fully dispensed or otherwise sufficiently depleted so as to merit replacement of a roll of web material, housing 202 can be opened and the remaining disposable insert 504, absent its respective supply of rolled web material 172, may be removed from the respective corresponding hub 502 or hub assembly and subsequently discarded and/or recycled, and a new authorized roll of web material 172 with a respective insert 504 orientation and construction in accordance with the respective one or more of support arms 22, 122 to provide the operative cooperation with the respective hub 502 or hub 602 can be associated with underlying dispenser assembly 28 for continued use thereof. Whether provided with one or more of, or mixed relations of, roll lockout systems 500, 600, dispenser assembly 28 can be expeditiously configured to allow operability of the dispenser assembly 28 to dispense only material from rolls of web material that have been previously designated as acceptable for use with the respective dispenser assembly 28.

Figure 3:
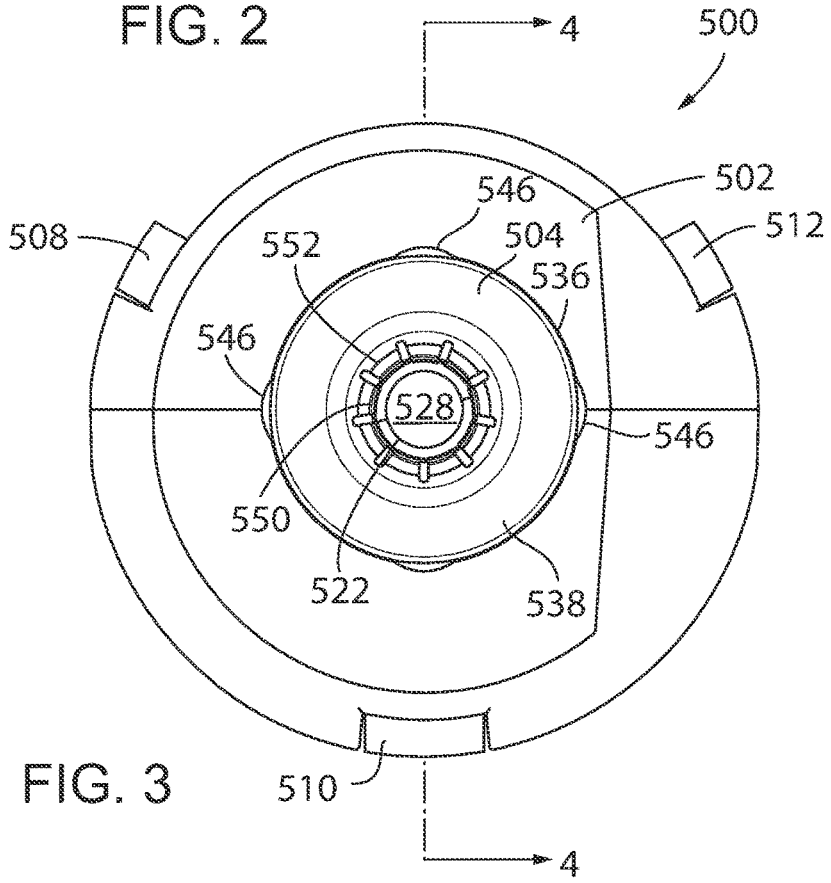
FIG. 3 is a roll facing axial end elevation view of the lockout assembly shown in FIG. 2.

FIGS. 2-5 show the hub 502 of roll lockout assembly or system 500 removed from dispenser assembly 28 and insert 504 removed from the roll of web material 172. Referring to FIGS. 2 and 3 and as disclosed above, hub 502 of lockout system 500 is constructed to removeably cooperate with insert 504. Hub 502 includes a dispenser facing side 506 having one or more projections 508, 510, 512 that are constructed to tool-lessly and preferably snap-fittingly, wholly or partially rotatably, or otherwise selectively removeably cooperate with at least one of roll support arms 20, 22 has disclosed above. It is appreciated that the size and shape of that portion of hub 502 that is constructed to engage the respective support arm could be provided in various sizes and shapes and constructed to cooperate with support arms having various constructions.

Hub 502 includes an engagement interface 516 that is constructed to rotationally support and axially cooperate with an engagement interface 518 associated with insert 504. Engagement interface 516 associated with hub 502 includes a first portion 520 that is generally defined by a post 522 that extends in an axial direction from a barrel portion 524 of hub 502 along an axis of rotation about axis 526 associated with the axis of rotation associated with a roll of web material 172 supported by lockout system 500. Post 522 extends along axial direction of axis 526 between barrel portion 524 and a distal end 528 defined by post 522. A channel 530 is formed proximate the cantilevered free end or distal end 528 of post 522 and is constructed a snap-fittingly cooperate with engagement interface 518 defined by insert 504 as disclosed further below.

Barrel portion 524 of hub 502 includes an outer radial portion 527 that extends an axial direction along axis 526 from the hub facing end of post 522. A shoulder 529 is defined by hub 502 and includes one or more ribs 525 that extend in axial direction 526 along the surface associated with radial portion 527 and cooperate with the radially inward facing or directed surface of insert 504 when insert 504 is engaged with hub 502. Channel 530 formed in post 522 proximate distal end 528 is constructed to axially cooperate with engagement interface 518 of insert 504 when insert 504 is engaged therewith and oriented for dispensing operation. Insert 504 is defined by a body 538 that includes an outwardly directed radial surface 536 that extends between the hub facing end 540 and an opposing or roll of web material facing end 544 of insert 504. One or more optional projections 546 extend in a generally outward radial direction relative to surface 536 of insert 504 and engage the radially inward facing surface of roll of web material 172 to secure insert 504 relative to the bore defined by the respective roll of web material, such as roll of web material 172, as disclosed above and as shown in FIG. 1.

Figure 4:
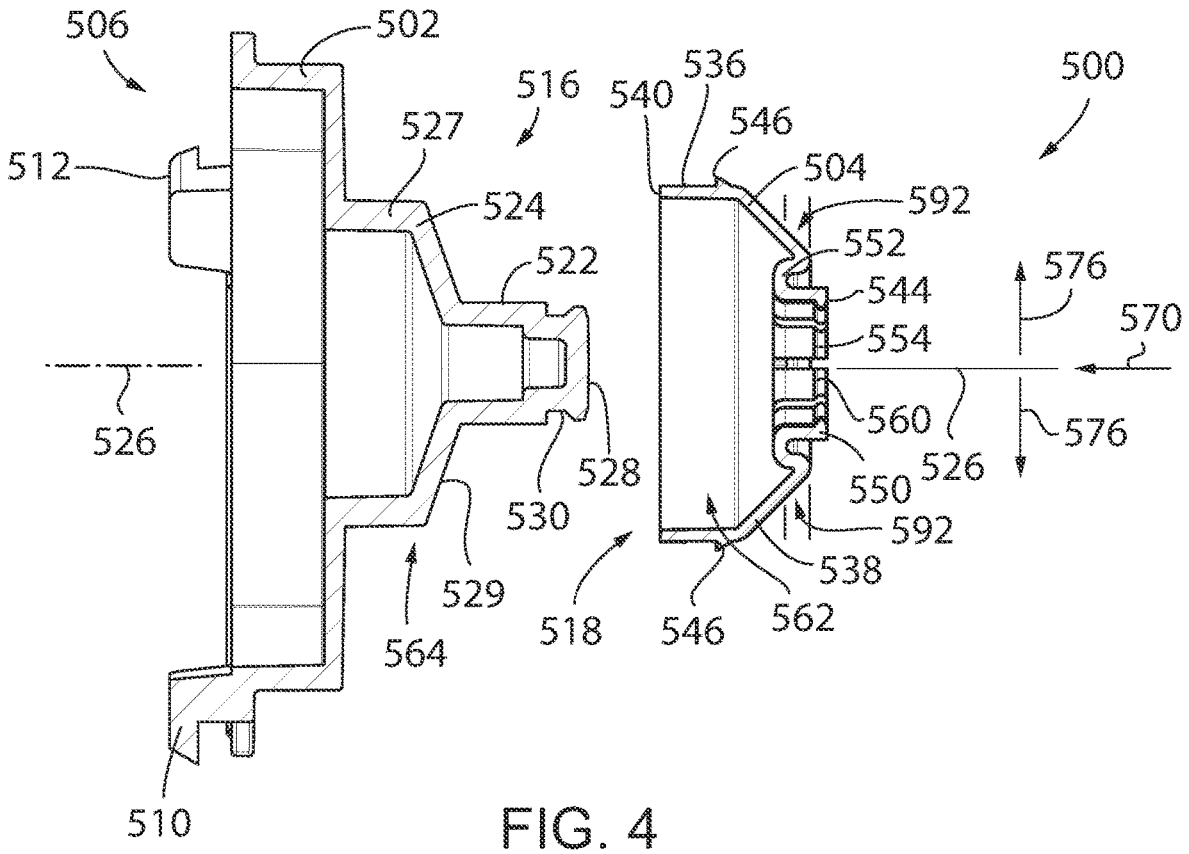
FIG. 4 is a cross section elevation view of the lockout system shown in FIG. 2 taken along line 4-4 shown in FIG. 3 with the insert disengaged from the hub.
Figure 5:
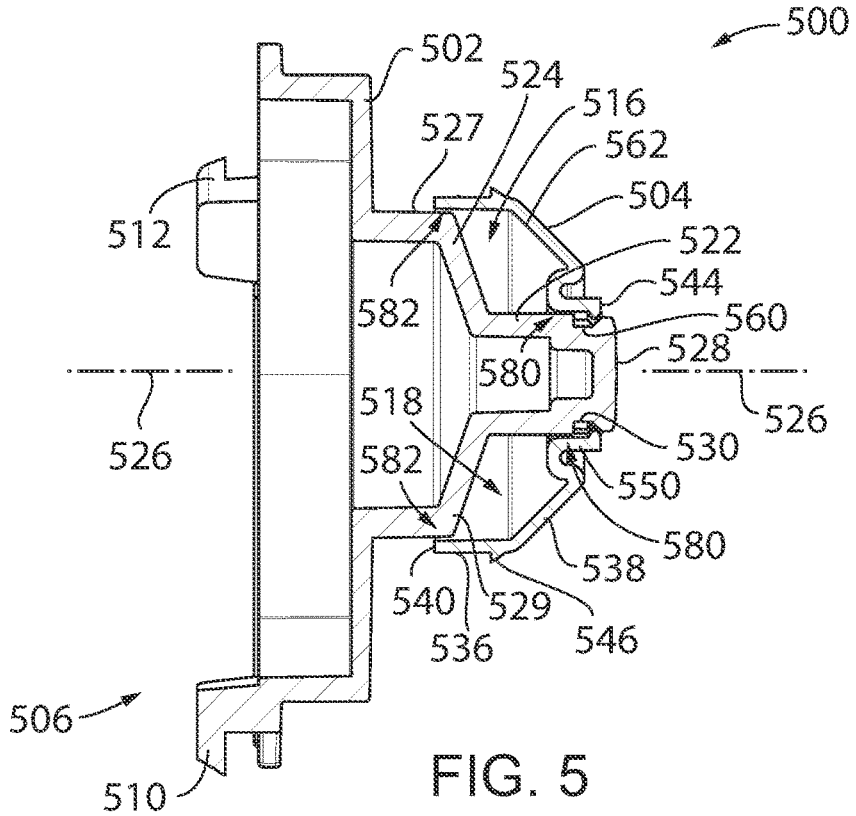
FIG. 5 is view similar to FIG. 4 with the insert and hub shown in FIG. 2 operationally engaged with one another.

Referring to FIGS. 2, 4, and 5, engagement interface 518 of insert 504 includes a plurality of retainers or fingers 550 that extend from body 538 of insert 504 are oriented in a cantilevered manner between respective discrete support ends 552 and respective distal or free ends 554 associated therewith. That is, although each of fingers 550 are defined by body 538 of insert 504, support ends 552 of fingers 550 are generally positionally associated with one another in a relatively continuous manner whereas each of discrete free ends 554 are independently moveable in an at least inward and outward radial directions relative one another. As disclosed further below, fingers 550 and body 538 are preferably formed to allow a limited degree of axial of axial displacement of free ends 554 relative to one another via an overlapping portion of body 538 of insert 504 as disclosed further below.

A number of projections 560 extend in a generally inward radial direction toward axis 526 from one or more of fingers 550 and preferably from each of fingers 550. As shown in FIGS. 4 and 5, insert 504 includes a radially inward directed cavity 562 that axially cooperates with a roll facing end portion 564 of hub 502 when hub 502 and insert 504 are engaged with one another. During axial translation of insert 504 toward hub 502, as indicated by arrow 570, distal end 528 of post 522 is shaped to slideably, and preferably snap-fittingly, cooperate with a cavity 572 defined by the circumference of fingers 550.

The slideable cooperation of post 522 with cavity 572 provides axial alignment of hub 502 relative to insert 504 during placement of a roll associated therewith relative to the underlying dispenser assembly 28. Continued axial translation of insert 504 relative to hub 502 in direction 570 allows distal end 528 of hub 502 to deflect discrete retainers or fingers 550 in outward radial directions, indicated by arrow 576, until discrete projections 560 associated with fingers 550 seat or otherwise slideably cooperate with channel 530 defined by hub 502 such that insert 504 is axially positioned relative to hub 502 and such that distal end 528 associated with post 522 is oriented laterally outboard relative to insert 504. Although post 522 extends through insert 504, it should be appreciated that the distal end 528 of post 522 is oriented in the bore associated with the roll of web material 172 associated with insert 504. When insert 504 and hub 502 are engaged with one another such that projections 560 associated with fingers 550 are engaged with channel 530 defined by hub 502, rotational interaction of insert 504 and the roll of web material associated therewith relative to hub 502 is provided in a manner that allows the roll of web material to be rotated but with limited free rotation therebetween after each dispense event. Such considerations mitigate instances of dispensing more web material than is desired and/or free spinning of the roll of web material 172 between dispense events.

Cooperation of one or more of projections 560 with cavity or channel 530 restricts axial translation of insert 504 relative to hub 502 when a respective roll of web material is associated therewith and without being acted upon by outside forces, such as a user's removal of remainder of a mostly consumed roll of web material or a discrete insert 504 associated with a recently consumed or fully dispensed roll of web material 172. As shown in FIG. 5, hub 502 and insert 504 cooperate with one another so as to define a first bearing surface 580 and a second bearing surface 582 that are formed between the respective adjacent radially facing surfaces of hub 502 and insert 504. Bearing surface 580 of roll lockout system 500 is radially nearer axial centerline 526 than bearing surface 582. It should also be noted that in addition to the radial spacing of bearing surfaces 580, 582, bearing surface 580 and bearing surface 582 are also offset relative to one another along axis 526. Such a construction provides stable rotational support between insert 504, and a roll of web material associated therewith, and the hub 502 associated with the respective underlying dispenser assembly and/or respective support arm 22, 122 associated therewith and as disclosed further above. Bearing surfaces 580, 582 further each provide a generally circumferential rotationally supported interaction between hub 502 and insert 504 when associated with one another and do so in a manner that offsets the rotational support between hub 502 and insert 504 from the axial indexing cooperation associated with the cooperation of projections 560 with channel 530. Such considerations provide robust rotational support between hub 502 and insert 504 to better accommodate the mass of a full roll of web material when associated therewith.

It is appreciated that the construction and orientation of the plurality of retainers or fingers 550 associated with roll lockout system 500 can similarly be provided in numerous configurations. As mentioned above, upon consumption of a discrete roll of web material associated with dispenser assembly 28 and supported by lockout system 500, user manipulation of insert 504 allows fingers 550 to deflect in respective outward radial directions, indicated by arrows 576, to facilitate the removal or disengagement of a discrete insert 504 from the relative underlying hub 502 to accommodate replacement, replenishment, or re-loading of dispenser assembly equipped with hub 502 with a roll of web material having an insert 504 associated with its bore and thereby correlating to an authorized respective roll of web material.

It is further appreciated that roll lockout system 500 can be configured with other radially spaced and/or numbers of deflectable retainers or fingers and/or numbers and constructions other than that which is shown in the drawings. For instance, it is appreciated that fingers 550 may be provided in more of fewer fingers 550 than shown in the figures, other radial shapes or sizes, and/or to have projections 560 associated therewith and/or configured to cooperate with a respective portion of insert 504 so as to facilitate the rotational cooperation therebetween, the axially indexed relative position therebetween, and do so in a manner that mitigates axial dissociation or translation of insert 504, and the roll of web material associated therewith, relative to hub 502, during use of the underlying dispenser assembly. It is envisioned that as few as two fingers 550 may be provided and may be provided to extend a similar or dissimilar circumferential distance about channel 530 and be spaced about the circumference thereof so as to maintain the desired rotational cooperation between hub 502 and a respective insert 504 associated therewith and without negating the manually separable cooperation of insert 504 with post 522 upon consumption or use of a discrete roll of discrete web material. As disclosed further below, it is appreciated that, due to the similarities in their size and constructions, insert 504 is preferably constructed to interchangeably cooperate with hubs or hub assemblies having constructions that differ from hub 502.

Referring to FIGS. 2, 4, and 5, body 538 of insert 504 of roll lockout system 500 includes an overlapping portion 592 such that body 538 of insert 504 has a generally S or Z shaped cross-sectional shape as the shape or cross-section of insert 504 progresses between end 544 associated with fingers 550 and hub facing end 540 of body 538. Although shown as being generally axially aligned with bearing surface 580 when insert 504 is engaged with hub 502, it is appreciated that overlapping portion 592 of insert 504 is may be disposed in alignment with bearing surface 582 or disposed between bearing surfaces 580, 582. It should be further appreciated that overlapping portion 592 of insert 504 is disposed between bearing surfaces 580, 582 in both the axial direction associated with axis 526 and the radial direction as indicated by arrows 576. As shown, the separation between adjacent fingers 550 extends between an open end proximate projections 560 and a closed end proximate overlapping portion 592 such that each finger 550 extends in a cantilevered manner relative to the remainder of body 538 from a position proximate overlapping portion 592.

Preferably overlapping portion 592 is formed toward the hub directed side of insert 504 relative to axis 526 and relative to end 544 thereof. That is to say, although insert 504 could be constructed such that overlapping portion 592 be oriented axially outboard of each of bearing surfaces 580, 582, overlapping portion 592 is preferably shaped and positioned to be axially aligned or overlapping in radial directions one of bearing surfaces 580, 582 or located axially therebetween. Regardless of the relative location, overlapping portion 592 is constructed to maintain the deflectable nature associated with operation of fingers 550 relative to hub 502, facilitate initial alignment of an insert 504 equipped roll of web material with hub 502, attain the desired engagement of a roll of web material with the dispenser, removal of any residual portion associated with a previously consumed roll of web material, and do not otherwise interfere with or detract from the dual bearing surface 580, 582 rotational support associated with the rotational dispensing engagement provided by the selectively severable association of discrete inserts 504 and hub 502.

FIGS. 6-9 disclose a roll lockout system 600 according to yet another embodiment of the application. Like lockout system 500 as disclosed above, lockout system 600 includes a hub 602 that is constructed to selectively cooperate with an insert such as insert 504 in the manner disclosed above. As such, like reference numbers are used hereafter with respect to the construction of insert 504. As disclosed above, insert 504 is constructed to cooperate with a bore 607 of a roll of web material 609 such that, when disposed therein, insert 504 is preferably rendered non-removable from roll of web material 609 save for the depletion thereof and/or destruction of any residual portion of the respective roll of web material such that insert 504 can be considered reusable, recyclable, and/or disposable.

Unlike the lockout system 500, hub 602 cooperates with a support arm or support arm assembly such that hub 602 is rendered movable relative thereto. As shown, hub 602 cooperates with a support assembly that includes a support arm 606 and a carriage 608 that is engaged therewith. Support arm 606 is defined by a body 610 that is constructed to engage a housing such as housing 202 (FIG. 1) in a manner according to one or more of the methodologies disclosed above. Preferably, body 610 of support arm 606 is constructed to snap-fittingly cooperate with the respecting housing such that a forward oriented hub supporting portion of body 610 is offset from the interior facing surfaces of the housing and such that roll of web material 609 can be supported by hub 602 when hub 602 is engaged with support arm 606.

A passage 612 is formed through body 610 of support arm 606 and is shaped to cooperate with respective portions of carriage 608 and hub 602 associated therewith as disclosed further below. One or more openings 614, 616, 618, 620 are formed through body 610 of support arm 606 and are generally disposed about passage 612. One or more handles or tabs 622, 624 extend in an outward radial direction from body 610 relative to passage 612. Tabs 622, 624 are generally accessible to the user to facilitate user interaction with support arm 606 and a respective core or cigar associated with a sufficiently depleted roll of web material 609 to assist with the selective separation between hub 602, the core or any portion of a spent roll of web material 609, or an insert 504 that may be associated therewith during reloading of a dispenser assembly equipped therewith.

Figure 7:
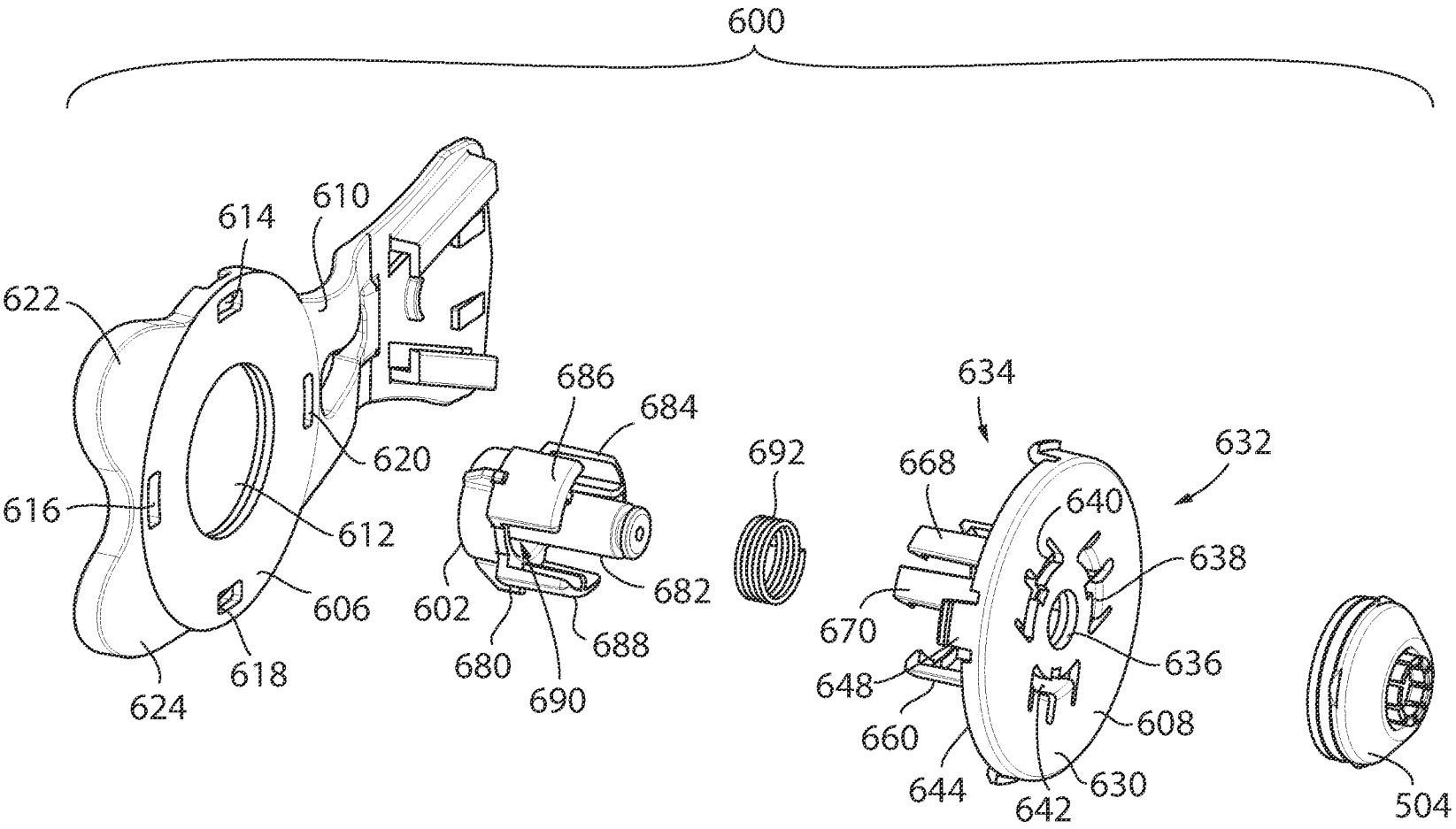
Figure 8:
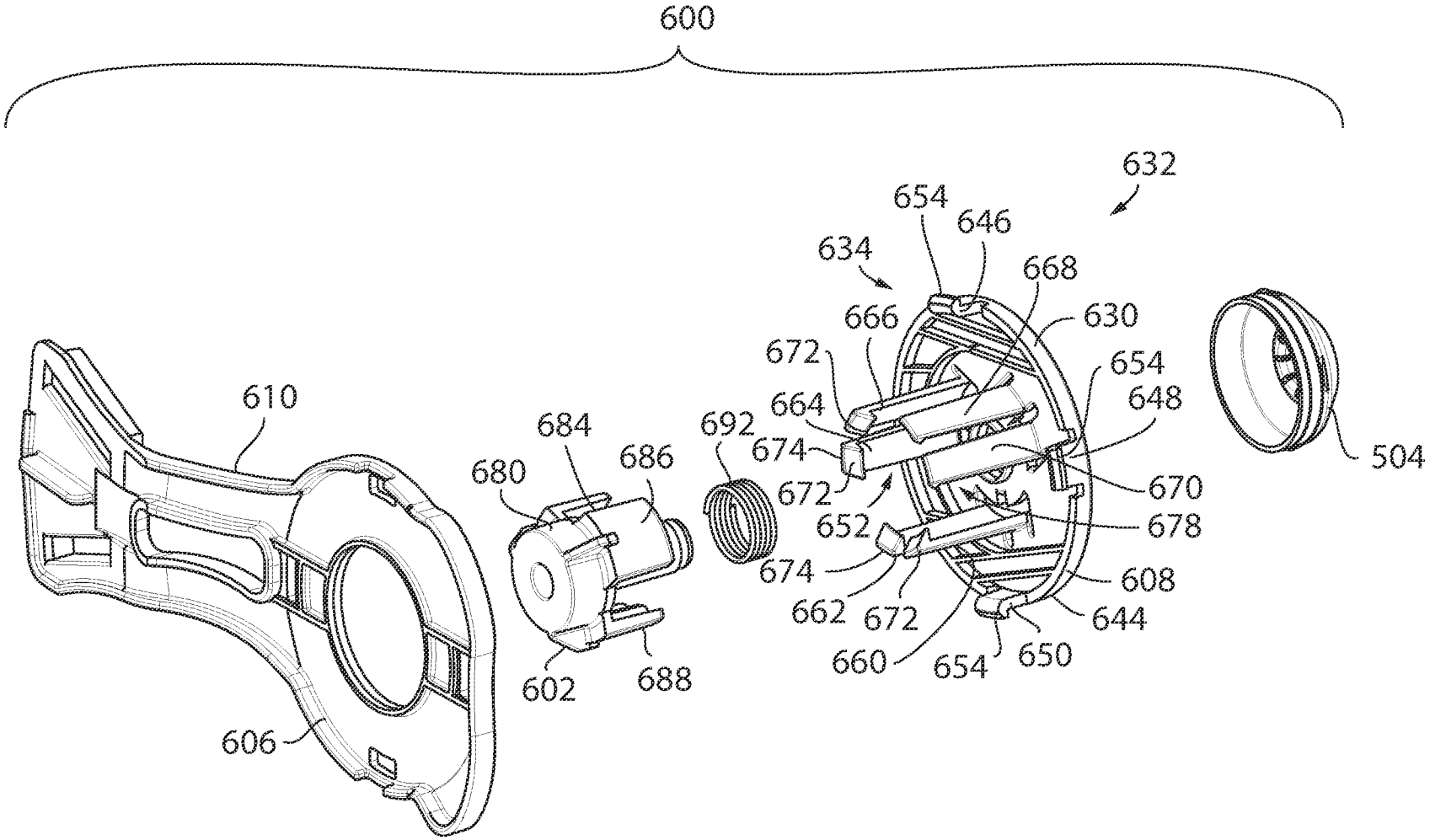
FIG. 8 is a dispenser facing exploded perspective view of the lockout assembly shown in FIG. 6.

Referring to FIGS. 7 and 8, carriage 608 is defined by a body 630 having a roll or insert facing surface or side 632 and a support arm facing surface or side 634. A passage 636 and one or more openings 638, 640, 642 are formed through body 630 of carriage 608. Openings 638, 640, 642 are generally disposed circumferentially about passage 636 such that each of passage 636 and openings 638, 640, 642 are fluidly isolated from one another and preferably circumferentially bounded by body 630 of carriage 608. As disclosed further below, such a construction maintains a relative rotational orientation of hub 602 relative to carriage 608 when hub 602 is associated therewith and in a manner that accommodates selective axial translation of hub 602 relative to carriage 608 in the manner disclosed further below.

A wall 644 is generally formed about a perimeter of body 630 and includes one or more projections 646, 648, 650, 652 that extend in an outward axial direction toward support arm 606. A catch 654 is formed proximate the distal end of each projection 646, 648, 650, 652. Catches 654 and projections 646, 648, 650, 652 are constructed and oriented to cooperate with respective openings 614, 616, 618, 620 defined by support arm 606 such that carriage 608 snap fittingly cooperates therewith such that carriage 608 is positionally fixed relative to support arm 606 when engaged therewith. A plurality of projections or arms 660, 662, 664, 666, 668, 670 extend in a rearward axial direction relative to support arm facing side 634 of carriage 608 and are disposed radially proximate openings 638, 640, 642 thereof. A barb 672 is formed near the free or distal end 674 of one or more of arms 660, 662, 664, 666, 668, 670. Arms 660, 662, 664, 666, 668, 670 are radially spaced from one another and oriented so as to generally define a hub cavity 678 therebetween. Arms 660, 662, 664, 666, 668, 670 are deflectable to accommodate association or placement of hub 602 within hub cavity 678 and have an at-rest orientation wherein barbs 672 overlap the radial footprint of hub 602 once hub 602 is position therein. As should be appreciated from FIG. 8, hub 602 is insertable into hub cavity 678 from a direction facing support arm 606 such that, once assembled, removal of hub 602 from hub cavity 678 in a direction toward the roll cavity of the dispenser cavity is prevented. As disclosed further below, hub cavity 678 is shaped to support hub 602 such that hub 602 is axially moveable or slideable therein relative to carriage 608.

Figure 6:
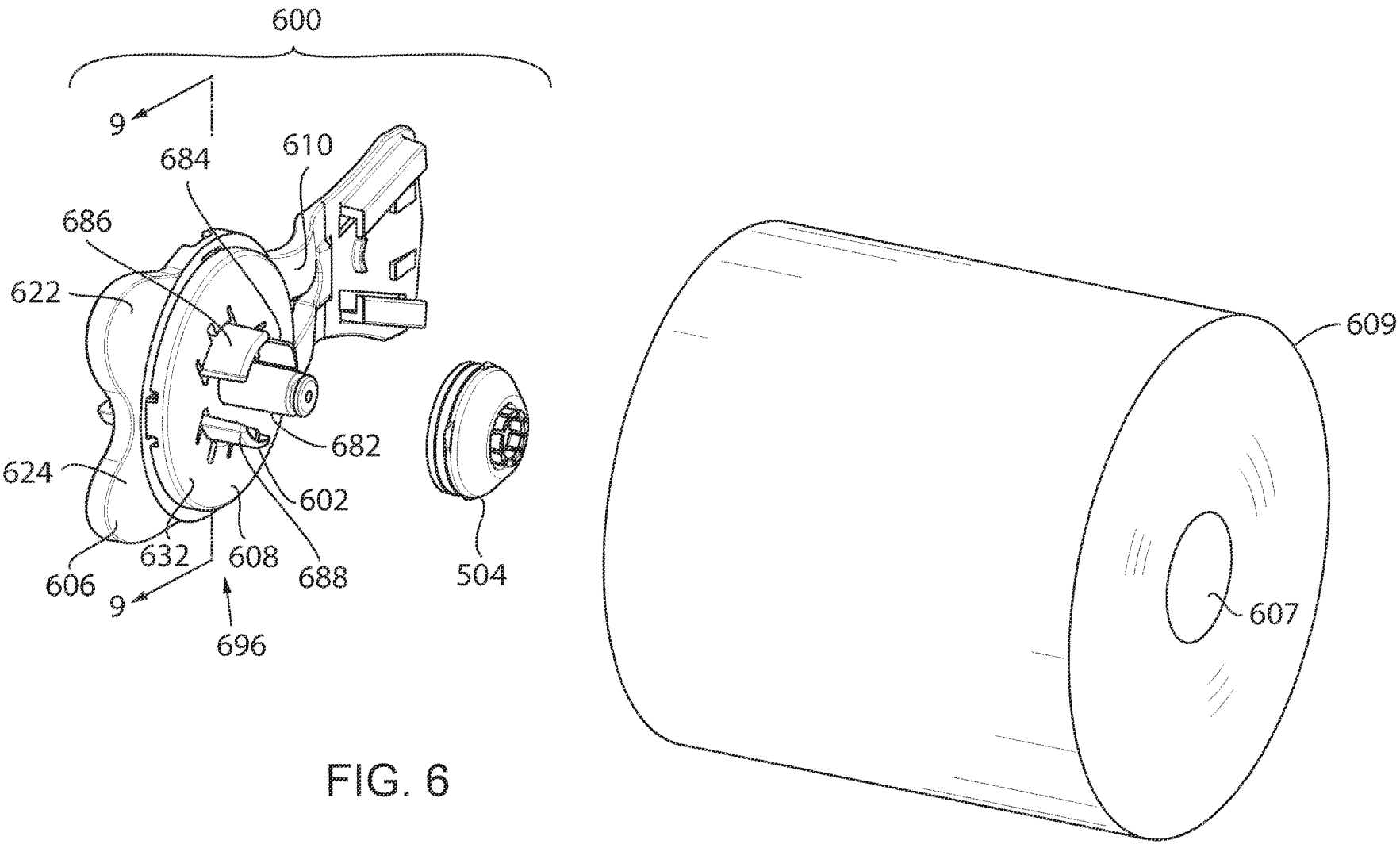
FIG. 6 is a perspective view a lockout system or rolled material lockout assembly according to another embodiment of the present invention.

Still referring to FIGS. 7 and 8, hub 602 is defined by a body 680 having a post 682 and one or more projections 684, 686, 688 that are disposed circumferentially thereabout. Body 680 of hub 602 defines a cavity 690 that is disposed between a portion of post 682 and generally bounded by projections 684, 686, 688. Cavity 690 is shaped to cooperate with a biasing device, such as a spring 692 or the like. When assembled, opposing ends of spring 692 cooperate with carriage 608 and hub 602 to urge hub 602 and carriage 608 toward one another. When assembled, biasing device 692 biases hub 602 relative to carriage 608 and support arm 606 toward an orientation wherein post 682 of hub 602 passes through passage 636 of carriage 608 and extends axially beyond roll facing surface 632 of carriage 608. When oriented in such a position, projections 684, 686, 688 of hub 602 pass through respective openings 638, 640, 642 defined by body 630 of carriage 608 and similarly extend axially beyond roll facing surface 632 of carriage 608 such that post 682 and projections 684, 686, 688 are each available for interaction with respective insert 504 and a roll of web material 609 associated therewith. Such an orientation is shown in FIG. 6 wherein post 682 and projections 684, 686, 688 associated with hub 602 are oriented in an exposed or accessible orientation 696 available for interaction with insert 504 and a respective roll of web material 609 associated therewith.

Figure 9:
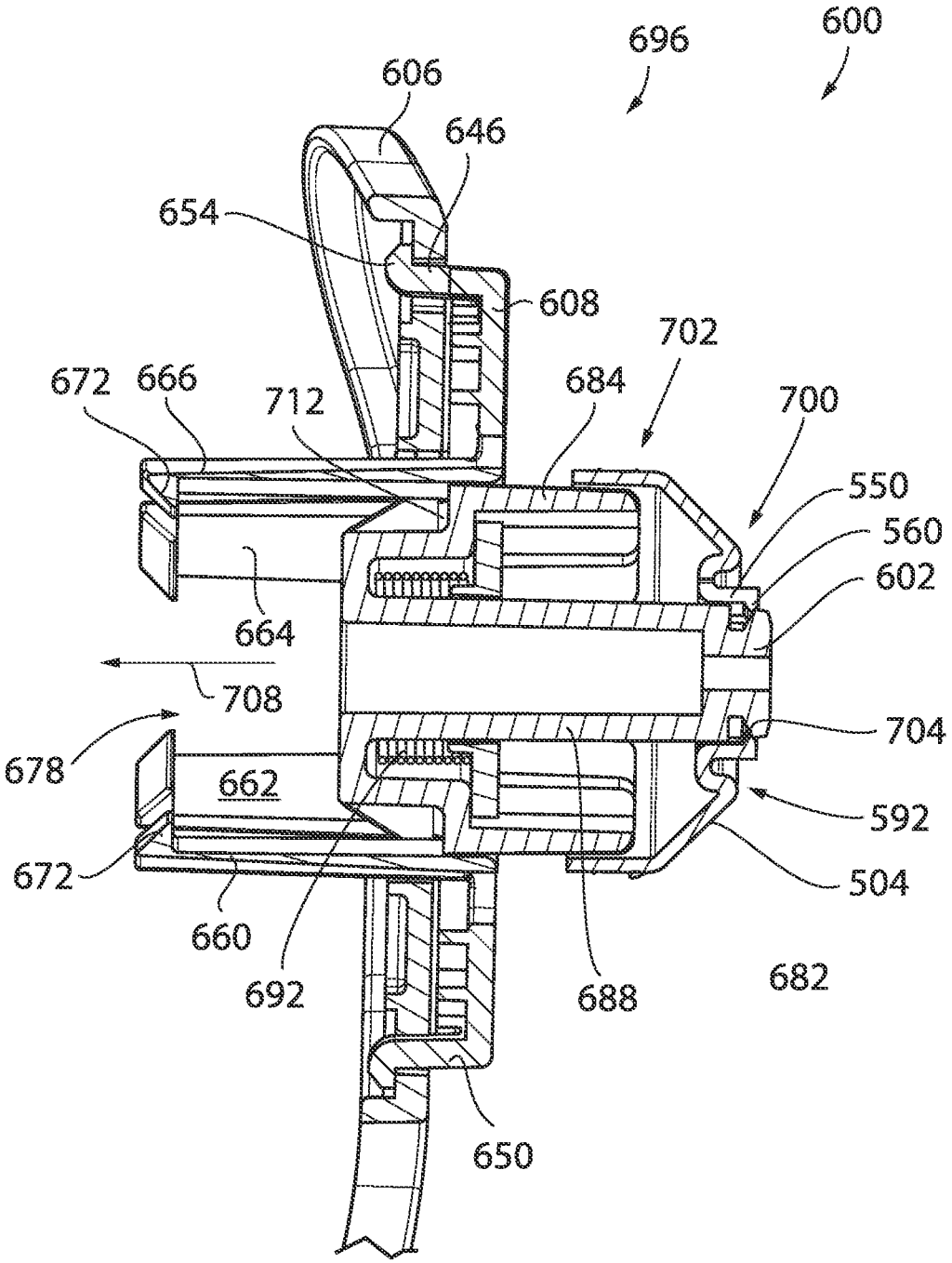
FIG. 9 is a cross section elevation view of the lockout assembly shown in FIG. 6 and with the insert operationally engaged with the hub and taken along line 9-9.

Referring to FIG. 9, when oriented in the accessible orientation 696, post 682 defines a first bearing surface or interface 700 associated with interaction with insert 504 and projections 684, 686, 688 define a second bearing surface or interface 702 associated with engaging a respective insert 504 having a construction suitable to allow operative rotational but axially fixed engagement therewith such that the projections 560 associated with respective fingers 550 are engaged with a channel 704 defined by post 682. Overlapping portion 592 of insert 504 rotationally cooperates with an exterior surface of post 682 and a radially outward directed surface of projections 684, 686, 688 rotationally cooperates with a radially inward facing surface of insert 504. It is appreciated that the relative position and construction of bearing surfaces 700, 702 and overlapping portion 592 associated with the cooperation and engagement of insert 504 and hub 602 can be provided in any of the alternate relative constructions, relative to one another and/or each other, disclosed above with respect to the cooperation of insert 504 with hub 502. Regardless of the relative configuration therebetween, biasing device 692 provides sufficient force to tolerate the slideable association of insert 504 with hub 602 such that projections 560 defined by insert 504 can achieve operative engagement with channel 704 defined by hub 602 when an insert constructed for operative engagement with hub 602 is associated therewith.

If however a user attempts to associate or otherwise engage a roll of web material having an improperly configured insert with hub 602, such action translates hub 602 in an axial or lateral direction, indicated by arrow 708, relative to carriage 608 within hub cavity 678 such that post 682 and projections 684, 686, 688 will retract through the respective passage and openings defined by carriage 608, and against the bias of spring 692, such that hub 602 is rendered no longer available or exposed for operative interaction with such an insert. Barbs 672 associated with arms 660, 662, 664, 666, 668, 670 mitigate undesired separation between hub 602 and carriage 608 during such instances and are oriented to interact with a stop 712 defined by body 680 of hub 602. Barbs 672 and stop 712 are configured and oriented to prevent continued lateral displacement of hub 602 relative to carriage 608 and to maintain the desired slideable association between post 682 and projections 684, 686, 688 of hub 602 with passage 636 and openings 638, 640, 642 of carriage 608, respectively.

During dissociation of the conflicting insert from interaction with hub 602, biasing device 692 acts to return hub 602 from retracted positions relative to carriage 608 toward the exposed, available, or accessible orientation or configuration 696 as the conflicting insert is moved away from or otherwise dissociated from interaction with hub 602. As such, when an appropriately configured insert 504 is associated with hub 602, the interface therebetween provides a configuration having multiple bearing supports and a methodology that prevents use of dispenser assemblies equipped with hub 602 for use with rolls of web material having inserts that are improperly configured for suitable rotational interaction with hub 602 by physical movement of hub 602 to positions wherein the hub is rendered unavailable for operational interaction with such inserts.

Therefore, a web material roll lockout assembly according to one embodiment of the present application discloses a hub that is constructed to be supported by a dispenser. An insert is constructed to rotationally cooperate with the hub when the insert is disposed in a bore of a roll of web material and the roll of web material is associated with the dispenser. A channel is formed in a radially outward oriented surface of the hub and positioned such that the channel is formed proximate an end of the hub. The assembly includes an insert that is constructed to removeably cooperate with the hub and has an overlapping portion formed between opposing ends of the insert. A plurality of projections are defined by the insert and constructed to limit axial translation between the insert and the hub when at least one of the plurality of projections is engaged with the channel and such that the overlapping portion of the insert improves flexibility associated with movement of the plurality of projections. A first rotational bearing surface and a second rotational bearing surface are defined between the insert and the hub when the at least one of the plurality of projections is engaged with the channel. The first rotational bearing surface and the second rotational bearing surface are positioned so that the overlapping portion of the insert is disposed therebetween.

Another embodiment of the present application discloses a method of restricting rolls of web material that can be dispensed from a roll dispenser. The method includes providing a hub that defines an axis of rotation of a roll of web material associated with the roll dispenser. An insert is provided that has an outer diameter that is constructed to securely engage a bore of a roll of web material and has a radially inward directed shape that slideably cooperates with the hub. A portion of the insert is formed to overlap itself as the insert traverses from opposing ends thereof and such that, when the insert is engaged with the hub, cooperation of the insert and the hub restricts axial translation between the hub and the insert and accommodates rotation of the insert relative to the hub during rotation of a roll of web material. Engagement of a respective insert with the hub defines at least two bearing surfaces between the insert and the hub wherein each of the at least two bearing surfaces are offset in an axial direction from respective longitudinal ends of the insert and the hub and such that the overlapping portion of the insert is preferably disposed between the at least two bearing surfaces.

A further embodiment of the present application discloses an insert for use in a roll web material dispenser assembly. The insert includes a body that extends between a first end and a second end of the insert. An outer surface of the body of the insert is shaped to be received in a roll of web material and an inner surface of the body of the insert is shaped to removeably cooperate with a hub associated with a dispenser and to define at least two bearing surfaces that are axially offset from one another when engaged with the hub. The insert includes a plurality of deflectable fingers that are associated with a first end of the body and a projection is associated with at least one of the plurality of deflectable fingers and oriented to engage a groove defined by the hub. The body defines an overlapping portion of the insert between the first end and the second end of the insert and is positioned between the at least two bearing surfaces.

Another embodiment of the application discloses a web material roll lockout assembly having a support arm that is constructed to engage a dispenser housing. A carriage is engaged with the support arm and a hub is supported by the carriage and movable relative to the carriage between an exposed position wherein a portion of the hub is accessible and a retracted position wherein the portion of the hub is inaccessible. A biasing device is configured to bias the hub toward the exposed position and an insert is constructed to be disposed in a bore of a roll of web material and to slideably cooperate with the hub so that the hub engages the insert without translating the hub relative to the carriage to the retracted position.

A further embodiment of the present application discloses a method of forming a web material lockout assembly. The method includes forming an insert so that an outer geometric shape allows the insert to be slideably received in a bore of a roll of web material and an inner geometric shape that is shaped to removeably cooperate with a hub supported by a dispenser. The hub is supported so that the hub is slideable relative to the dispenser so that the hub is unavailable for engagement if an insert having a different inner geometric shape is attempted to be associated therewith.

A further embodiment of the present application discloses a web material dispenser lockout system that includes a support assembly that is constructed to cooperate with a dispenser housing. A hub slideably engages the support assembly so that the hub is movable between an extended position and a retracted position. A biasing device is engaged with the hub and oriented to bias the hub toward the extended position. An insert is constructed to be disposed in a bore of a roll of web material and has a radially interior facing geometry that allows the insert to cooperate with the hub without translating the hub toward the retracted position.

It is appreciated that various features and aspects disclosed in the present application may be implemented in a variety of configurations, using certain features or aspects of the several embodiments described herein and others known in the art. Thus, although the invention has been herein shown and described in what is perceived to be the most practical and preferred embodiments, it is to be understood that the invention is not intended to be limited to the specific features and embodiments set forth above. It is recognized that modifications may be made by one of skill in the art of the invention without departing from the spirit or intent of the invention and, therefore, the invention is to be taken as including all reasonable equivalents to the subject matter of the claims.

What is claimed is:

1. A web material roll lockout assembly comprising:

a support arm constructed to engage a dispenser housing;

a carriage engaged with the support arm;

a hub supported by the carriage and movable relative to the carriage between an exposed position wherein a portion of the hub is accessible and a retracted position wherein the portion of the hub is inaccessible;

a biasing device configured to bias the hub toward the exposed position;

an insert that removeably cooperates with the hub and is constructed to be disposed in a bore of a roll of web material and to slideably cooperate with the hub so that the hub engages the insert without translating the hub relative to the carriage toward the retracted position; and wherein the hub further comprises a plurality of projections that extend beyond a roll facing side of the carriage when the hub is oriented in the exposed position and wherein the plurality of projections include a center post and a plurality of support blades that are oriented circumferentially about the center post.

2. The web material roll lockout assembly of claim 1 wherein the carriage includes an opening associated with each of the center post and each of the plurality of support blades and each opening is circumferentially surrounded by the carriage.

3. The web material roll lockout assembly of claim 1 wherein the carriage further comprises a plurality of fingers that extend through the support arm and are oriented to surround the hub so that the hub is slideable relative thereto.

4. The web material roll lockout assembly of claim 3 wherein the hub snap-fittingly cooperates with the carriage from a first axial direction and the carriage snap-fittingly cooperates with the support arm from a second axial direction that is opposite the first axial direction.

5. The web material roll lockout assembly of claim 1 wherein the biasing device is further defined as a spring that is captured between the carriage and the hub.

6. A method of forming a web material lockout assembly, the method comprising:

forming an insert so that an outer geometric shape allows the insert to be slideably received in a bore of a roll of web material and an inner geometric shape of the insert is shaped to removeably cooperate with a hub supported by a dispenser;

supporting the hub so that the hub is biased in an axial direction toward the insert and is slideable relative to the dispenser so that the hub is rendered inaccessible for supporting engagement if an insert having a different inner geometric shape is attempted to be operatively associated therewith; and providing a spring between the hub and a support arm that is attached to the dispenser and providing a plurality of openings in the support arm that each cooperate with a discrete projection defined by the hub.

7. The method of claim 6 further comprising biasing the hub toward an exposed position.

8. The method of claim 6 further comprising forming the insert having the inner geometric shape and the hub to define a plurality of bearing surfaces between the insert and the hub.

9. The method of claim 8 further comprising forming one of the plurality of bearing surfaces between the insert and the hub to be axially and radially offset from another one of the plurality of bearing surfaces.

10. The method of claim 6 further comprising securing the insert relative to the bore of the roll of web material so that the insert is reusable.

11. The method of claim 6 further comprising forming the insert to include an overlapping portion.

12. The method of claim 6 further comprising forming a plurality of deflectable fingers at a distal end of the insert and orienting the plurality of fingers to snap-fittingly cooperate with a groove formed in a center post of the hub.

13. A web material dispenser lockout system comprising:

a support assembly constructed to cooperate with a dispenser housing;

a hub slideably engaged with the support assembly so that the hub is movable between an extended position and a retracted position;

a biasing device engaged with the hub and oriented to bias the hub toward the extended position;

an insert constructed to be disposed in a bore of a roll of web material and having a radially interior facing geometry that allows the insert to removeably cooperate with the hub without translating the hub toward the retracted position when the insert is engaged with the hub;

wherein the support assembly further comprises a support arm that is constructed to engage the dispenser housing and a hub support that is constructed to cooperate with the support arm and slideably support the hub; and wherein the hub support further comprises an inner bore that is constructed to slideably cooperate with a post defined by the hub and a plurality of openings that are oriented about the inner bore wherein each opening is shaped to slideably cooperate with a respective arm defined by the hub.

14. The web material dispenser lockout system of claim 13 wherein the hub support further comprises a plurality of fingers oriented to surround the hub and accommodate slideable support of the hub relative to the hub support.

15. The web material dispenser lockout system of claim 13 further comprising a first bearing surface and a second bearing surface between the hub and the insert that are radially and axially offset from one another when the insert is engaged with the hub.

16. The web material dispenser lockout system of claim 13 wherein the insert further comprises an overlapping portion.

17. A web material roll lockout assembly comprising:

a support arm constructed to engage a dispenser housing;

a carriage engaged with the support arm and having a plurality of fingers that extend through the support arm;

a hub supported by the carriage and movable relative to the carriage between an exposed position wherein a portion of the hub is accessible and a retracted position wherein the portion of the hub is inaccessible;

a biasing device configured to bias the hub toward the exposed position;

an insert that removeably cooperates with the hub and is constructed to be disposed in a bore of a roll of web material and to slideably cooperate with the hub so that the hub engages the insert without translating the hub relative to the carriage toward the retracted position; and wherein the plurality of fingers of the carriage are oriented to surround the hub so that the hub is slideable relative thereto.

18. The web material roll lockout assembly of claim 17 wherein the hub snap-fittingly cooperates with the carriage from a first axial direction and the carriage snap-fittingly cooperates with the support arm from a second axial direction that is opposite the first axial direction.

19. A method of forming a web material lockout assembly, the method comprising:

forming an insert so that an outer geometric shape allows the insert to be slideably received in a bore of a roll of web material and an inner geometric shape of the insert is shaped to removeably cooperate with a hub supported by a dispenser;

supporting the hub so that the hub is biased in an axial direction toward the insert and is slideable relative to the dispenser so that the hub is rendered inaccessible for supporting engagement if an insert having a different inner geometric shape is attempted to be operatively associated therewith; and forming the insert having the inner geometric shape and the hub to define a plurality of bearing surfaces between the insert and the hub.

20. The method of claim 19 further comprising forming one of the plurality of bearing surfaces between the insert and the hub to be axially and radially offset from another one of the plurality of bearing surfaces.

21. A method of forming a web material lockout assembly, the method comprising:

forming an insert so that an outer geometric shape allows the insert to be slideably received in a bore of a roll of web material and an inner geometric shape of the insert is shaped to removeably cooperate with a hub supported by a dispenser;

supporting the hub so that the hub is biased in an axial direction toward the insert and is slideable relative to the dispenser so that the hub is rendered inaccessible for supporting engagement if an insert having a different inner geometric shape is attempted to be operatively associated therewith; and forming a plurality of deflectable fingers at a distal end of the insert and orienting the plurality of fingers to snap-fittingly cooperate with a groove formed in a center post of the hub.

22. A web material dispenser lockout system comprising:

a support assembly constructed to cooperate with a dispenser housing;

a hub slideably engaged with the support assembly so that the hub is movable between an extended position and a retracted position;

a biasing device engaged with the hub and oriented to bias the hub toward the extended position;

an insert constructed to be disposed in a bore of a roll of web material and having a radially interior facing geometry that allows the insert to removeably cooperate with the hub without translating the hub toward the retracted position when the insert is engaged with the hub;

wherein the support assembly further comprises a support arm that is constructed to engage the dispenser housing and a hub support that is constructed to cooperate with the support arm and slideably support the hub; and wherein the hub support further comprises a plurality of fingers oriented to surround the hub and accommodate slideable support of the hub relative to the hub support.

23. A web material dispenser lockout system comprising:

a support assembly constructed to cooperate with a dispenser housing;

a hub slideably engaged with the support assembly so that the hub is movable between an extended position and a retracted position;

a biasing device engaged with the hub and oriented to bias the hub toward the extended position;

an insert constructed to be disposed in a bore of a roll of web material and having a radially interior facing geometry that allows the insert to removeably cooperate with the hub without translating the hub toward the retracted position when the insert is engaged with the hub; and a first bearing surface and a second bearing surface between the hub and the insert that are radially and axially offset from one another when the insert is engaged with the hub.

24. The web material dispenser lockout system of claim 23 wherein the insert further comprises an overlapping portion.

* * * * *